US010540946B2

(12) United States Patent
Reddick

(10) Patent No.: US 10,540,946 B2
(45) Date of Patent: Jan. 21, 2020

(54) PORTABLE, MODULAR PLATFORM FOR ASSEMBLING A STRINGED INSTRUMENT

(71) Applicant: Ian Reddick, Savannah, GA (US)

(72) Inventor: Ian Reddick, Savannah, GA (US)

( * ) Notice: Subject to any disclaimer, the term of this patent is extended or adjusted under 35 U.S.C. 154(b) by 0 days.

(21) Appl. No.: 16/264,103

(22) Filed: Jan. 31, 2019

(65) Prior Publication Data

US 2019/0237047 A1 Aug. 1, 2019

Related U.S. Application Data

(60) Provisional application No. 62/625,322, filed on Feb. 1, 2018.

(51) Int. Cl.

| | |
|---|---|
| ***G10D 3/12*** | (2006.01) |
| ***G10D 1/08*** | (2006.01) |
| *G10D 3/06* | (2006.01) |

(52) U.S. Cl.
CPC ..... *G10D 1/085* (2013.01); *G10D 3/12* (2013.01); *G10D 3/06* (2013.01)

(58) Field of Classification Search
CPC ..... G10D 1/085; G10D 3/12; G10D 3/06
See application file for complete search history.

(56) References Cited

U.S. PATENT DOCUMENTS

| | | | | |
|---|---|---|---|---|
| 4,425,831 | A | 1/1984 | Lipman | |
| 4,433,603 | A | 2/1984 | Siminoff | |
| 5,347,904 | A | 9/1994 | Lawrence | |
| 5,383,385 | A | 1/1995 | Gilbert | |
| 5,637,823 | A | 6/1997 | Dodge | |
| 5,929,362 | A * | 7/1999 | Oteyza | G10D 1/085 84/293 |
| 5,945,614 | A | 8/1999 | White | |
| 5,994,633 | A | 11/1999 | Norton | |
| 6,046,393 | A | 4/2000 | Rose | |
| 6,194,644 | B1 | 2/2001 | Hendrickson | |
| 6,274,800 | B1 | 8/2001 | Gardner | |
| 6,653,538 | B1 | 11/2003 | Wells | |
| 6,911,590 | B2 | 6/2005 | Childress | |
| 7,002,065 | B2 | 2/2006 | Petersen | |
| 7,256,343 | B2 | 8/2007 | Brubaker | |
| 7,285,709 | B2 | 10/2007 | White | |
| 7,417,185 | B2 | 8/2008 | Ludwig | |
| 7,442,865 | B2 | 10/2008 | Moghaddam | |

(Continued)

*Primary Examiner* — Kimberly R Lockett
(74) *Attorney, Agent, or Firm* — John G. Posa; Belzer PC

(57) ABSTRACT

A portable, modular guitar platform enables guitarists to explore the potential of their instrument by allowing a user to mix and match many different functional modules, including modules handmade by a luthier or other skilled artisan. The design accommodates many options for customization, may use off-the-shelf components, is highly portable, and can be made from a variety of materials. The arrangement enhances ease of maintenance, and reduces waste from defective components in manufacturing. While the preferred embodiment captures the standard functionality of an electric guitar in a collapsible and customizable package, the modular nature of the platform allows for the expansion of this functionality. Any number of other technologies, electronic or mechanical, may be incorporated to expand the functionality of the platform in practice, performance, and recording contexts.

15 Claims, 9 Drawing Sheets

(56) References Cited

U.S. PATENT DOCUMENTS

| | | | | |
|---|---|---|---|---|
| 7,732,702 | B2 | 6/2010 | Ludwig | |
| 7,838,758 | B2 | 11/2010 | Ekstrom | |
| 9,378,711 | B1 | 6/2016 | Stadnyk | |
| 9,454,947 | B1 | 9/2016 | Hart | |
| 9,520,109 | B1 | 12/2016 | Edwards | |
| 9,852,718 | B1 | 12/2017 | Kelly | |
| 2003/0164080 | A1* | 9/2003 | Childress | G10D 1/00 84/291 |

* cited by examiner

Figure 12
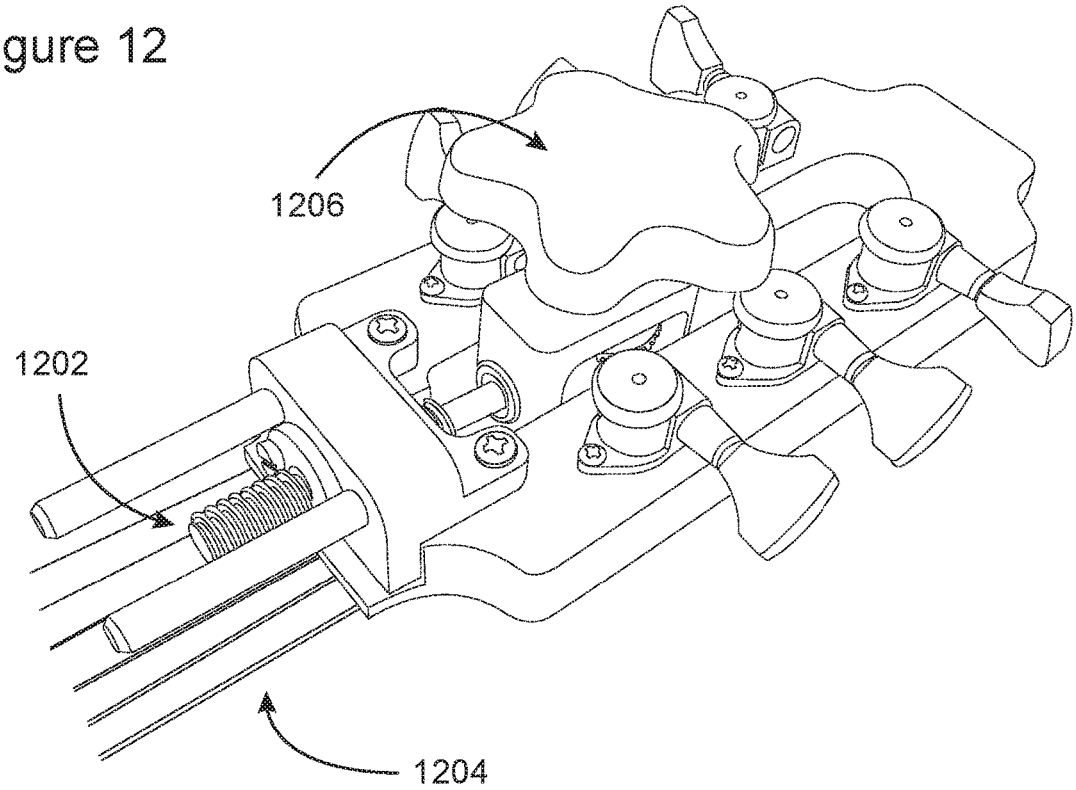
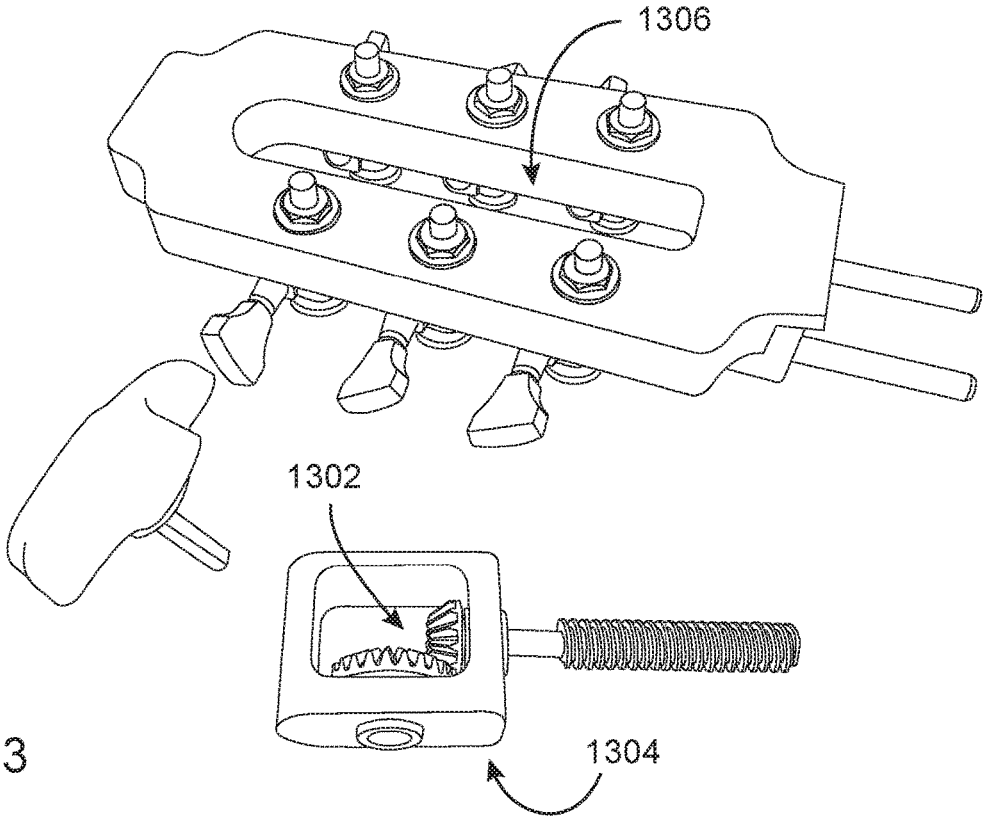
Figure 13

PORTABLE, MODULAR PLATFORM FOR ASSEMBLING A STRINGED INSTRUMENT

REFERENCE TO RELATED APPLICATIONS

This invention claims priority to, and the benefit of, U.S. Provisional Patent Application Ser. No. 62/625,322, filed Feb. 1, 2018, the entire content of which is incorporated herein by reference.

FIELD OF THE INVENTION

This invention relates generally to stringed instruments and, in particular, to a portable, modular platform for assembling guitars and other stringed instruments.

BACKGROUND OF THE INVENTION

Many guitarists will not fly with a guitar, as they are often too bulky to carry onto a plane, and they frequently break in checked baggage. They are expensive to repair, and when broken they are completely out of commission until repaired by a specialist.

When professionals must travel to gig or record with their guitar, they purchase expensive cases to protect their gear, but still worry about damage. Bringing multiple instruments on a plane is even more difficult, but it is sometimes necessary. Professionals rarely use "travel" guitars for paid work, as they are rarely of professional quality.

SUMMARY OF THE INVENTION

This invention is directed to a portable, modular platform particularly suited to assembling customized electric guitars and other stringed instruments. It represents an improvement on previous designs, in that it accommodates many options for customization, may use off-the-shelf components, is highly portable, and can be made from a variety of materials. The design allows for many different functional modules, including modules handmade by a luthier or other skilled artisan. The design enhances ease of maintenance, and reduces waste from defective components in manufacturing.

The portable, modular platform includes a receiver unit constructed from two opposing, spaced-apart rigid rails. A neck block is disposed at one end of the receiver unit, and a neck module is removably received by the neck block. A bridge block is removably mounted between rails of the receiver unit, and a bridge mounts to the bridge block. An electrified embodiment includes a pick-up module also removably received between the rails of the receiver, and wherein the top surface of the pick-up module includes one or more pick-ups for detecting string vibrations and converting the string vibrations into electrical signals. The neck, bridge and pick-up modules may be used to construct an instrument with any number of strings, including 6-string, 12-string and bass guitars.

One or both of the opposing side surfaces of the receiver unit are configured to receive instrument body pieces that define the outer shape of the instrument. At least one of the instrument body pieces may include a cavity to receive an electrical control module that receives and modifies the electrical signals from the pick-up module through wired or wireless interconnections between the pick-up module and the instrument body piece including the control module.

The platform further includes a headstock that removably couples to the distal end of the neck module. The coupling may include an adjustable tensioning mechanism that allows slack to be introduced into strings between the headstock and bridge sufficient for the bridge to be removed from the bridge block. In the preferred embodiment, the headstock includes two parallel pins that slide into the distal end of the neck module to facilitate lateral movement of the headstock while preventing rotational movement. The tensioning mechanism may include a lead screw that bears against the distal end of the neck module to adjust the distance between the headstock and the neck module, using a knob, lever, or key to turn the lead screw.

The platform may include various additional control modules such as amplifiers, sound effects generators, preamps, recording interfaces, signal buffers, and control surfaces. The platform may further including a support member enabling two receiver units to be coupled to one another to construct an instrument with two necks.

The invention provides a platform for musicians to explore the potential of their instrument. While the preferred embodiment captures the standard functionality of an electric guitar in a collapsible and customizable package, the modular nature of the platform allows for the expansion of this functionality. Any number of other technologies, electronic or mechanical, may be incorporated to expand the functionality of the platform in practice, performance, and recording contexts.

BRIEF DESCRIPTION OF THE DRAWINGS

FIG. 12 is a detail view of a tensioning mechanism; and

FIG. 13 shows how a gearbox is not physically connected to the headstock, allowing the headstock to move along a lead screw.

DETAILED DESCRIPTION OF THE PREFERRED EMBODIMENTS

Figure 1:
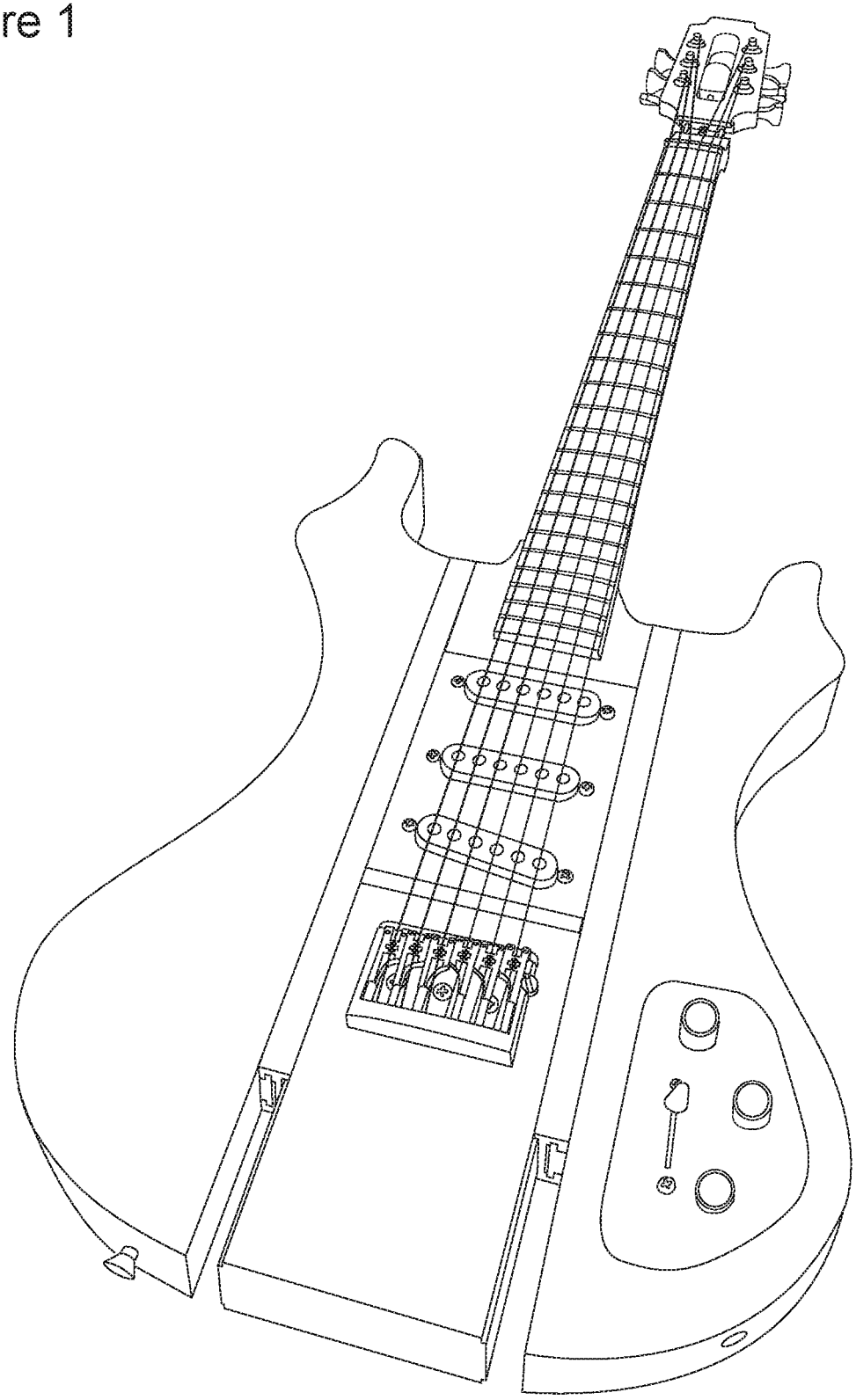
FIG. 1 shows an embodiment of the invention in the form of an electric stringed instrument in an assembled state.
Figure 2:
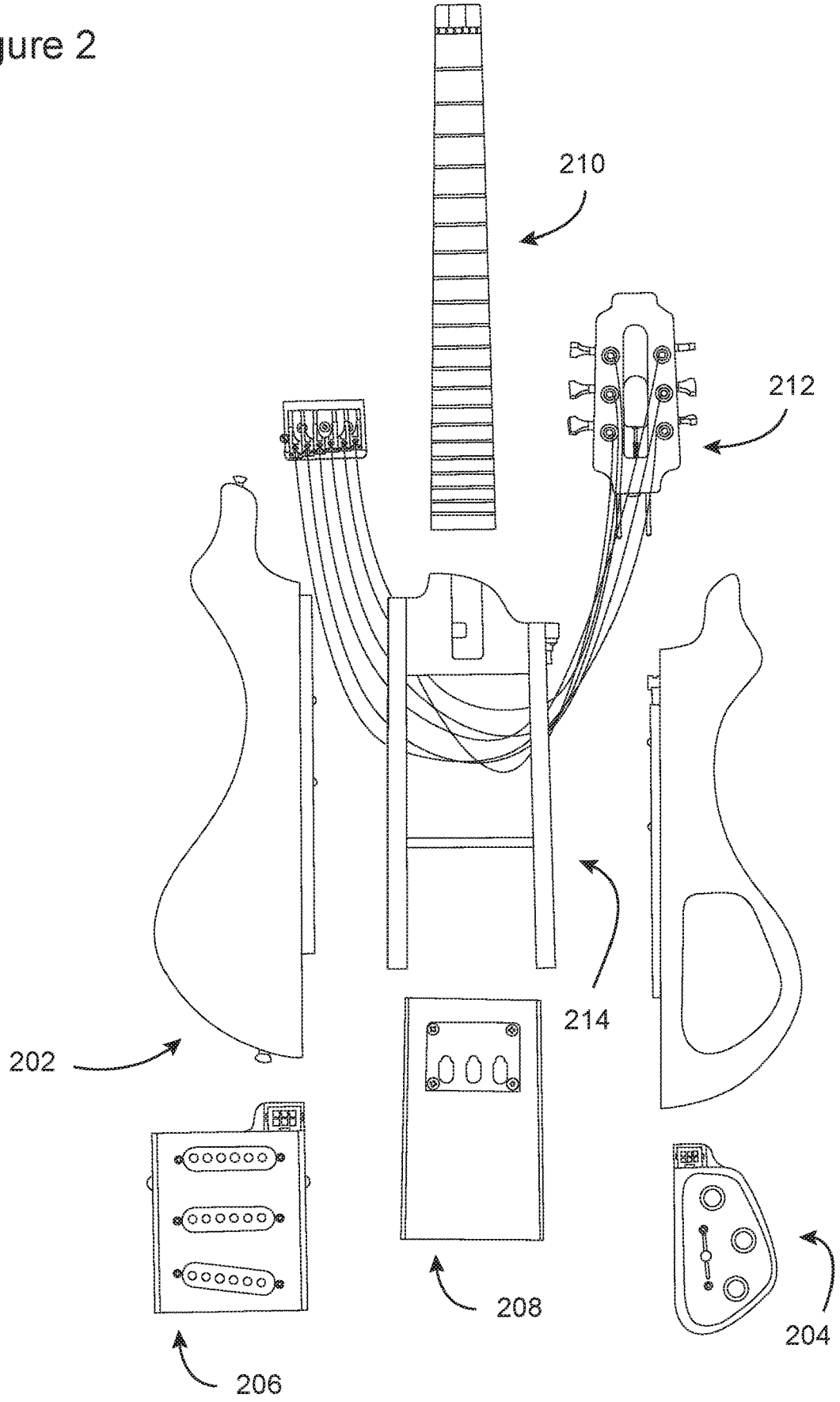
FIG. 2 shows the instrument of FIG. 1 in a disassembled state.

FIG. 1 shows an embodiment of the invention in the form of an electric stringed instrument in an assembled state. FIG. 2 shows the instrument of FIG. 1 in a disassembled state. While a 6-string electric guitar is illustrated, the invention is applicable to other stringed instruments including bass guitars, violins, cellos, violas, the standing double bass, mandolins, banjos, ukuleles, and so on, in electric or electric/acoustic form.

As shown in the disassembled state of FIG. 2, the instrument is composed of removable modules, which may include body sides 202, control modules 204, pickup modules 206, bridge blocks 208, necks 210, headstocks 212, receivers 214, and accessories (not shown) such as amplifiers, sound effects, preamps, recording interfaces, signal buffers, control surfaces, etc. It is important to appreciate that not all of the modules shown or described here need to be provided in combination with the invention, and any subset of the modules disclosed may represent patently distinct subject matter.

Figure 3:
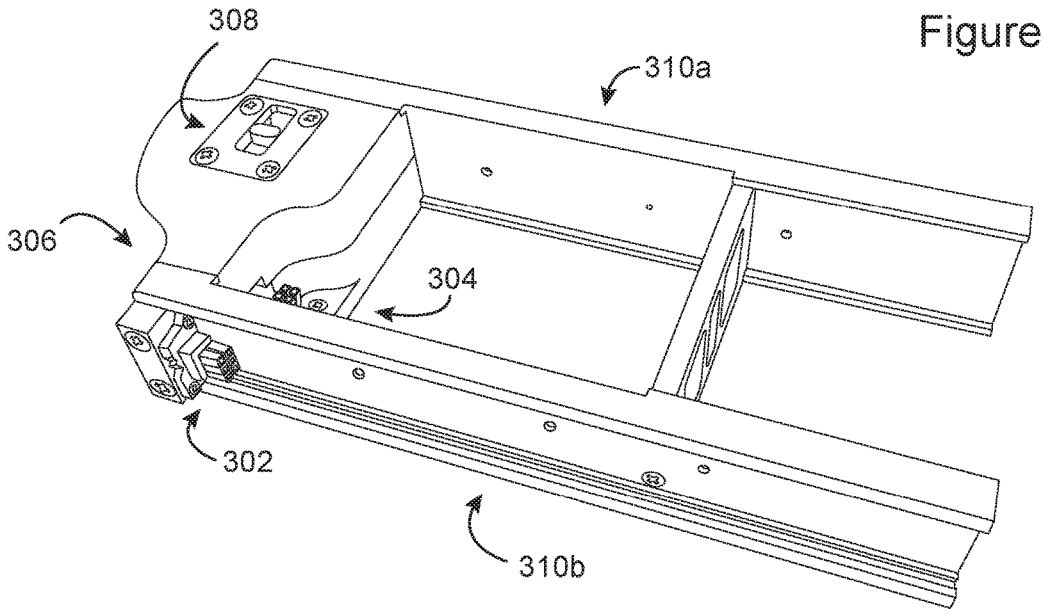
FIG. 3 is a perspective view of a receiver component according to the invention.
Figure 4:
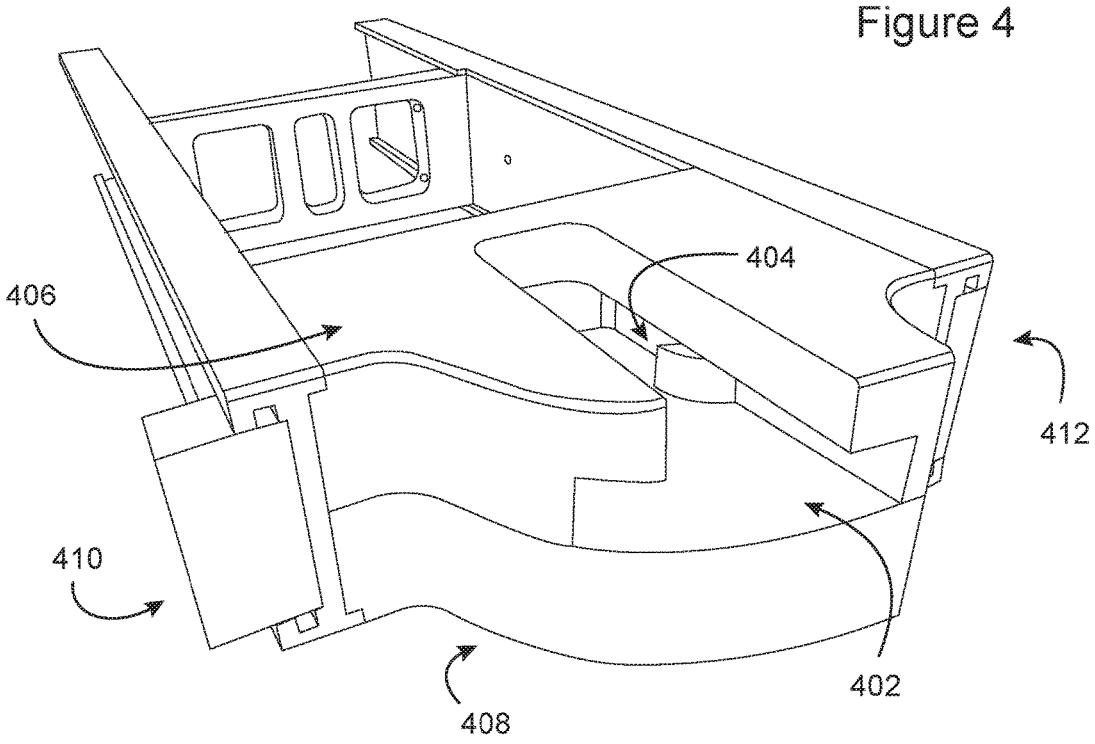
FIG. 4 is a different perspective view of the receiver component.
Figure 5:
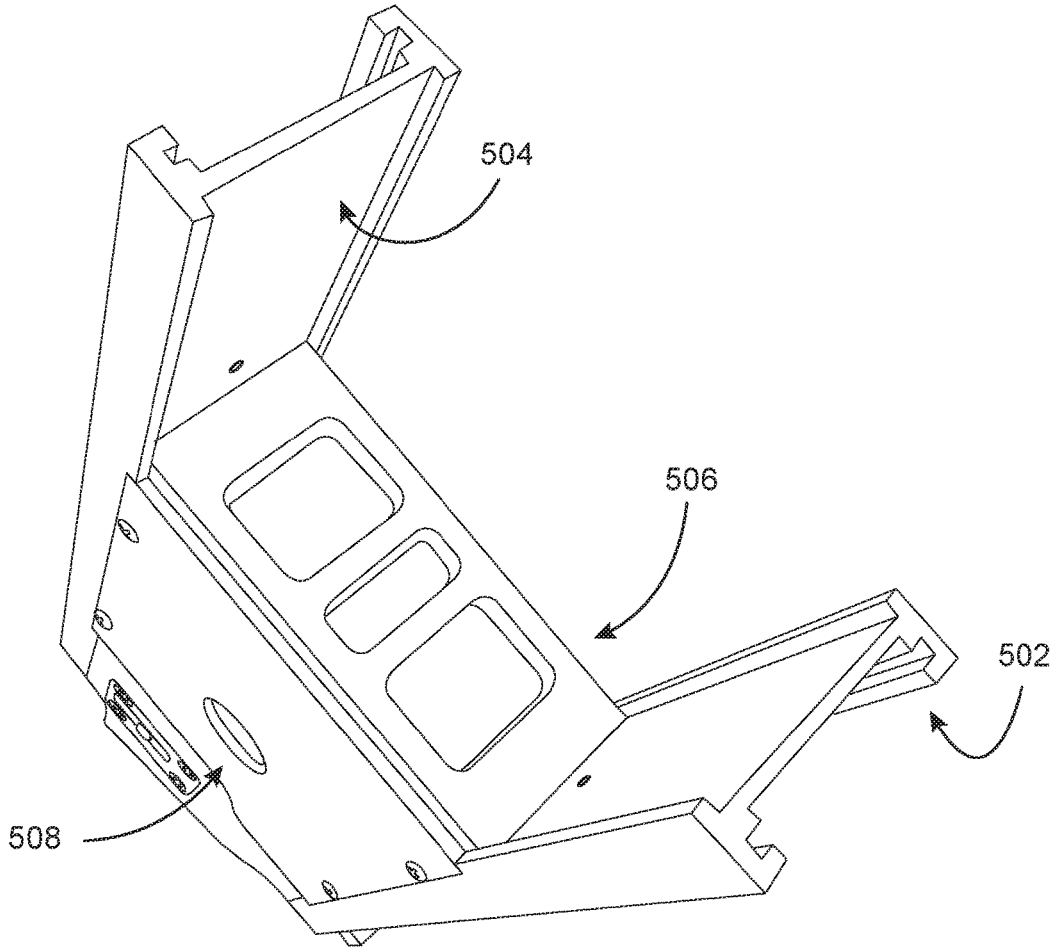
FIG. 5 is a further perspective view of the receiver component.

The modules fit into a receiver FIGS. 3, 4, 5 made of a lightweight rigid material such as aluminum or carbon fiber. The receiver is the skeleton of the instrument, providing strength and rigidity, and allows the modules to be made with any functionality and with any material having suitable aesthetic, strength, and weight characteristics. The individual components comprising the receiver are bolted together or otherwise reversibly bonded such that these components may be replaced, maintained, or remanufactured.

The receiver features a contoured block with a slot 402 for the neck, a latch 404 that holds the neck in place, multiple mounted electrical connectors such as 302, and wiring (not shown). The receiver may be contoured in such a way that the player has easy playing access to the upper frets of the neck, without corners or pressure points restricting access in this area.

A neck block may be made in two or more parts 406, 408 to allow a variety of manufacturing methods to be used, for weight reduction, and for easy assembly and maintenance. The neck block may feature a tapered slot so the neck can wedge in place and self-align in the event of wear. The front piece of the neck block 406 features an attachment point for electrical connectors 304, a channel where wiring can be run, a keyed and tapered slot 402 that interfaces with the neck, weight relief channels, and threaded bolt holes. The back piece of the block 408 acts as the bearing surface for the neck heel when under tension. It is hollow for weight relief, and features an enclosure for the neck latch, openings for wiring to be run, bolt holes, and screw bosses.

A spring-loaded latch 404 fits into this block such that it can slide laterally. It is held in place by a latch plate 308, which is bolted to the back of the block. The latch is not essential to the function of the neck block, as string tension holds the neck in place. However, the latch allows the user to hold the instrument by the neck while it is not under tension.

The receiver also features rails 310*a*, 310*b*, which secure other modules in place. In the embodiment shown, the rails are bolted to the neck block, and the rails have two sides. The first side 502 features slots, which interface with the male end of a matched rail connected to the body sides 602. The slots are offset from the flat surface of the rail so they can be machined with an inexpensive key slot cutter. The second side 504 features low walls that prevent an enclosed module from escaping. There may be slots along the rail to allow wiring to pass through, and holes for bolts. The rails may or may not contain wiring.

Stop blocks 410, 412 bolted to the top of the rails prevent the body modules from sliding too far along the rail. The blocks may be rectangular or shaped such that they blend into the contours of the body sides. They may be fitted with electronic connectors 302 for making contact with the electronics in the body sides.

A retainer 506 bridges the two rails, connecting them together. The retainer is bolted (or otherwise reversibly attached) to the rails. Its function is to keep the rails parallel and to give the bridge block a surface to rest against while the instrument is under tension. The retainer shown is rectangular with weight relieving cutouts. The retainer may or may not feature an electrical connector and wiring.

Figure 6:
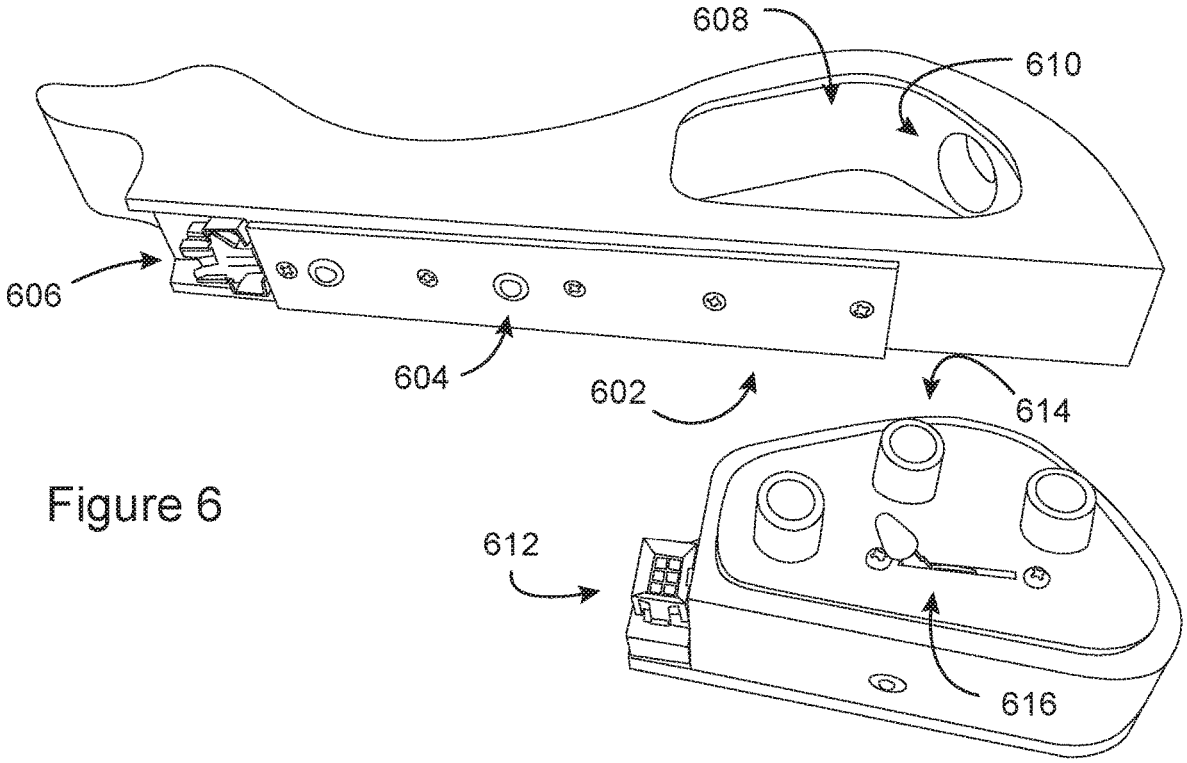
FIG. 6 illustrates a control module that couples to one of the body sides and locks in place.

The body modules of FIG. 6 are received by the outside rails using a mated rail 602. This rail may be made from nylon or any other material that is sufficiently durable and low-friction. The body sides lock mechanically in place via a device such as a ball plunger 604, latch, or thumbscrew, which interfaces with slots or detents in the rail. Body modules may be made out of any material, and may contain wiring, electrical connectors 606, slots for additional modules 608, or a variety of other built-in devices such as amplifiers, effects, preamps, recording interfaces, signal buffers, control surfaces, etc. They may be chambered to reduce weight and enhance acoustics.

A module (not shown) may be inserted to link two individual receivers together, effectively making an instrument with two or more necks. This module may be fitted with electrical connectors and wiring that would pass signals to an accessory slot for output or from one receiver to the output of another. It may be fitted with controls, switches, accessory slots, control surfaces, electronic components, mixers, etc.

A control module FIG. 6 slides into one of the body sides and locks in place. This control module is hollow and contains wiring, various analog or digital electrical components (such as electrical connectors 612, potentiometers 614, switches 616, circuit boards, etc.) and a means of signal output (such as a ¼" output jack, a wireless transmitter, a USB device, etc.) In the embodiment shown, the control module features an electrical connector 612, potentiometers 614, a switch 616, and a ¼" output jack (not shown).

A hole in the body side 610 allows a patch chord to be plugged directly into the control module. The control module may be removed from the body side by a finger hole in the back of the module and secures itself in place with a ball plunger and detent, though other embodiments may have latches, handles, knobs, hooks, or any other combination of a touch point for removal and a reversible mechanical fastener to hold it in place.

Figure 7:
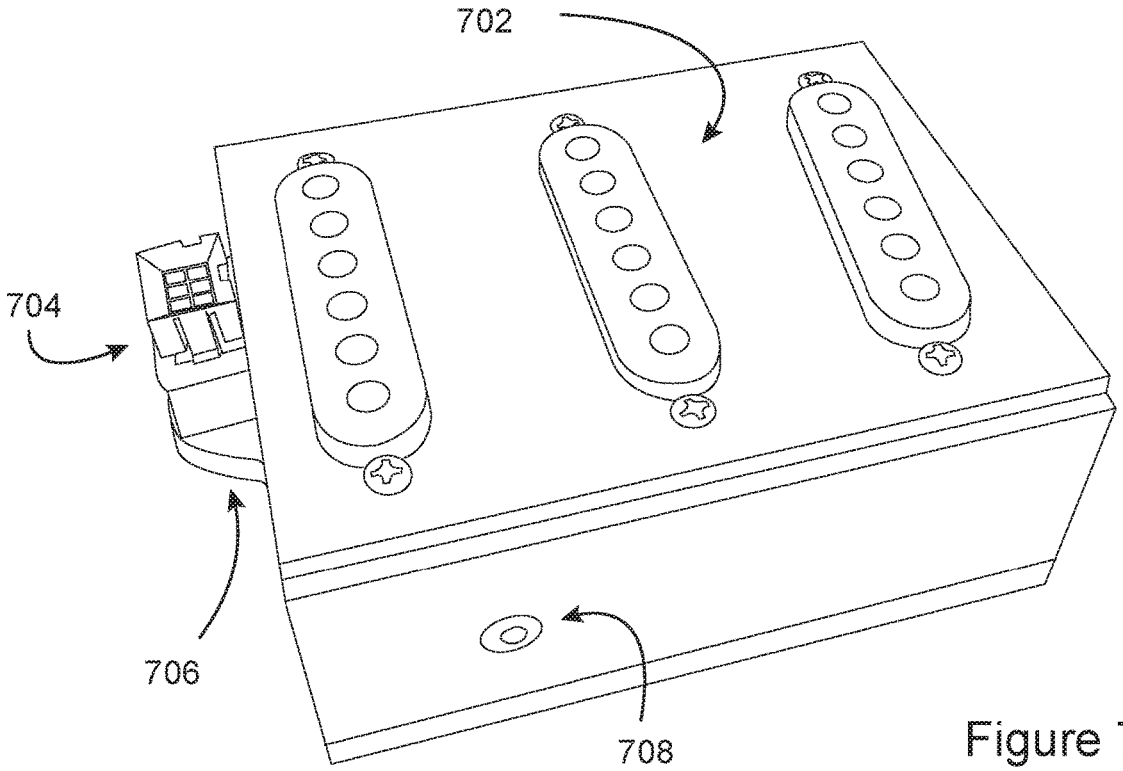
FIG. 7 depicts a pickup module.

A pickup module FIG. 7 is received by the receiver 214 from the back so it can be removed without disturbing the strings. The function of the pickup module is to detect the vibrations of the strings though various methods and devices such as a magnetic pickup 702, piezoelectric pickup, hexaphonic pickup, or optical pickup. It is surrounded by the rails, the bridge retainer, and the neck block, and outputs signal to the wiring in the neck block. It is presently secured in place with ball plungers 708, and prevented from escaping through the front of the instrument by the walls on the inside of the rails 504, but this module could be held in place by any number of mechanisms.

A finger hole 508 in the back of the module may be used for removal, but any manner of touch point may be used to remove the module. The pickup module is a hollow rectangular box with slots for pickups 702 to pass through, and wiring inside the box, which connects to an electrical connector 704, which is mounted externally to a tab 706.

Figure 8:
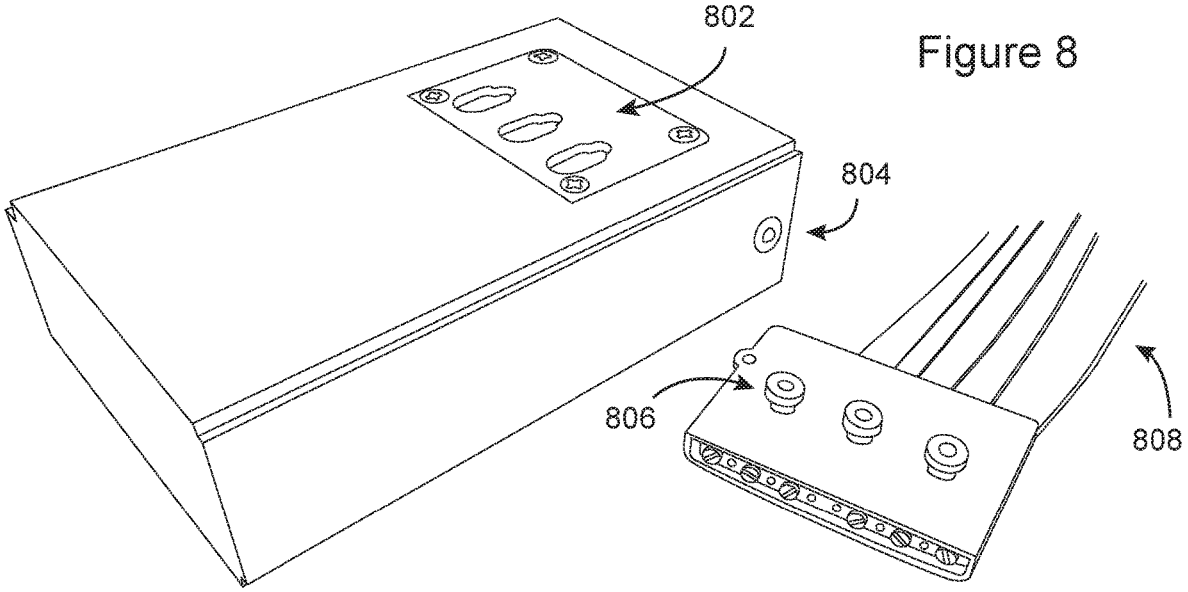
FIG. 8 shows a bridge block.
Figure 9:
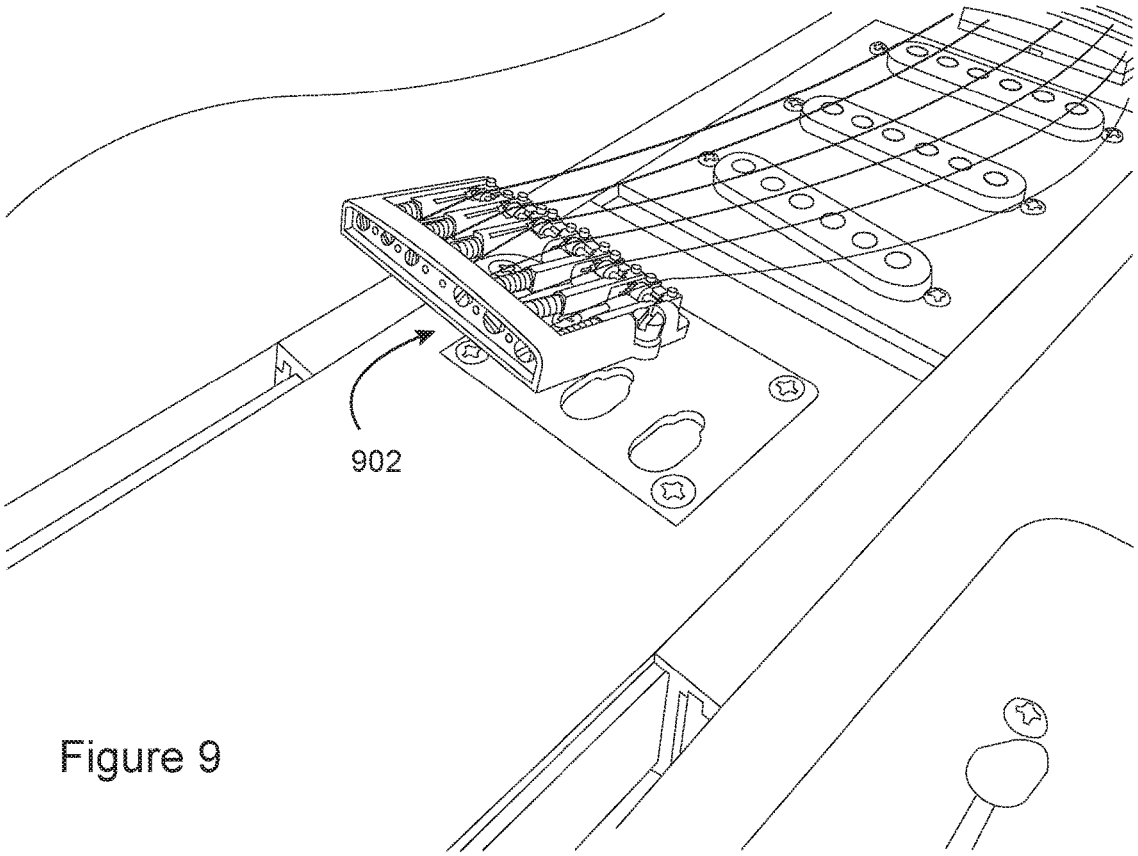
FIG. 9 is a bridge.

A bridge block FIG. 8 mounts between the rails 310*a*, 310*b* and rests against the retainer 506. The inner walls of the rails 504 prevent its escape, and the block locks mechanically in place by way of ball plungers 804, latches, hooks, etc. The bridge 902, which secures the strings 808 to the body and may enable various adjustments such as string height, spacing, intonation, and tuning or contain a vibration detection device such as a piezoelectric pickup, mounts reversibly to this block such that it is secured in place when the instrument's strings are under tension FIG. 9. This connection may be achieved by way of T-slots 802, hooks, posts, etc.

The bridge 902 may be an off-the-shelf component or a custom component. In the present iteration, the block features an aluminum plate with t-slots 802, and a matched nut 806 is bolted to the bridge 902, which is an off-the-shelf component. The block may also contain wiring and various electronic or mechanical devices, including but not limited to piezoelectric components, control surfaces, accessory slots, percussion instruments, additional string instruments, effects, power supplies, etc.

A bridge ground (not shown) is featured in the block and may be connected to the instrument's ground circuit by way of contact with a metallic receiver, connection into wiring integrated into a rail, an electrical connector mounted to the receiver, a connection into the pickup module, etc. Contact with the bridge ground is made when the bridge is mounted to the block.

Figure 10:
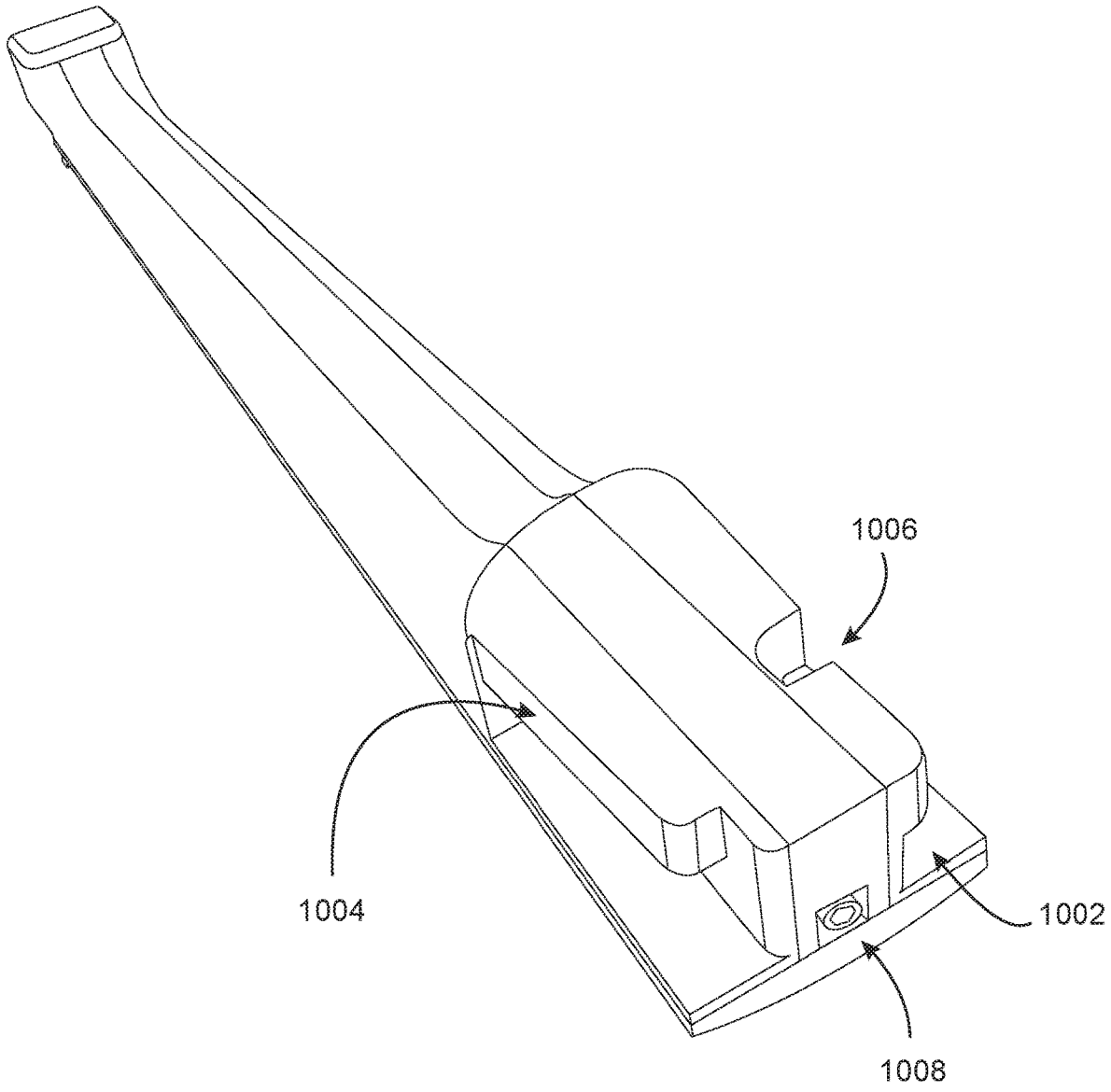
FIG. 10 shows a neck, which may be fretted or unfretted.

A fretted or unfretted instrument neck FIG. 10 or digital control surface mounts to the block FIG. 4 such that it cannot escape when the instrument is under tension. It is slotted 1002 to interface with the neck block, with a wedged heel 1004 that helps self-align the neck. It may feature a slot 1006 that interfaces with the neck latch 404 so the neck can lock in place to secure the neck while it is not under tension. The top of the neck features a slotted nut, which holds the strings in proper alignment.

The neck can be made out of any sufficiently rigid material, such as wood, graphite, carbon fiber, or aluminum. It may contain a truss rod 1008 for neck relief adjustment, various internal or external reinforcement methods, or wiring for lighting or string detection methods. It may be fitted with an electronic connector for outputting signal or inputting power. The back of the neck is shaped to fit the player's hand and playing preferences. It may feature frets, which are press fit into the fretboard. In its present iteration, the neck features holes (not shown) that are drilled at an appropriate angle for pins that connect the headstock to the neck at the proper angle (i.e., 11°). The holes are fitted with bushings that allow the pins to slide easily and prevent wear and deformation in the wooden neck.

Figure 11:
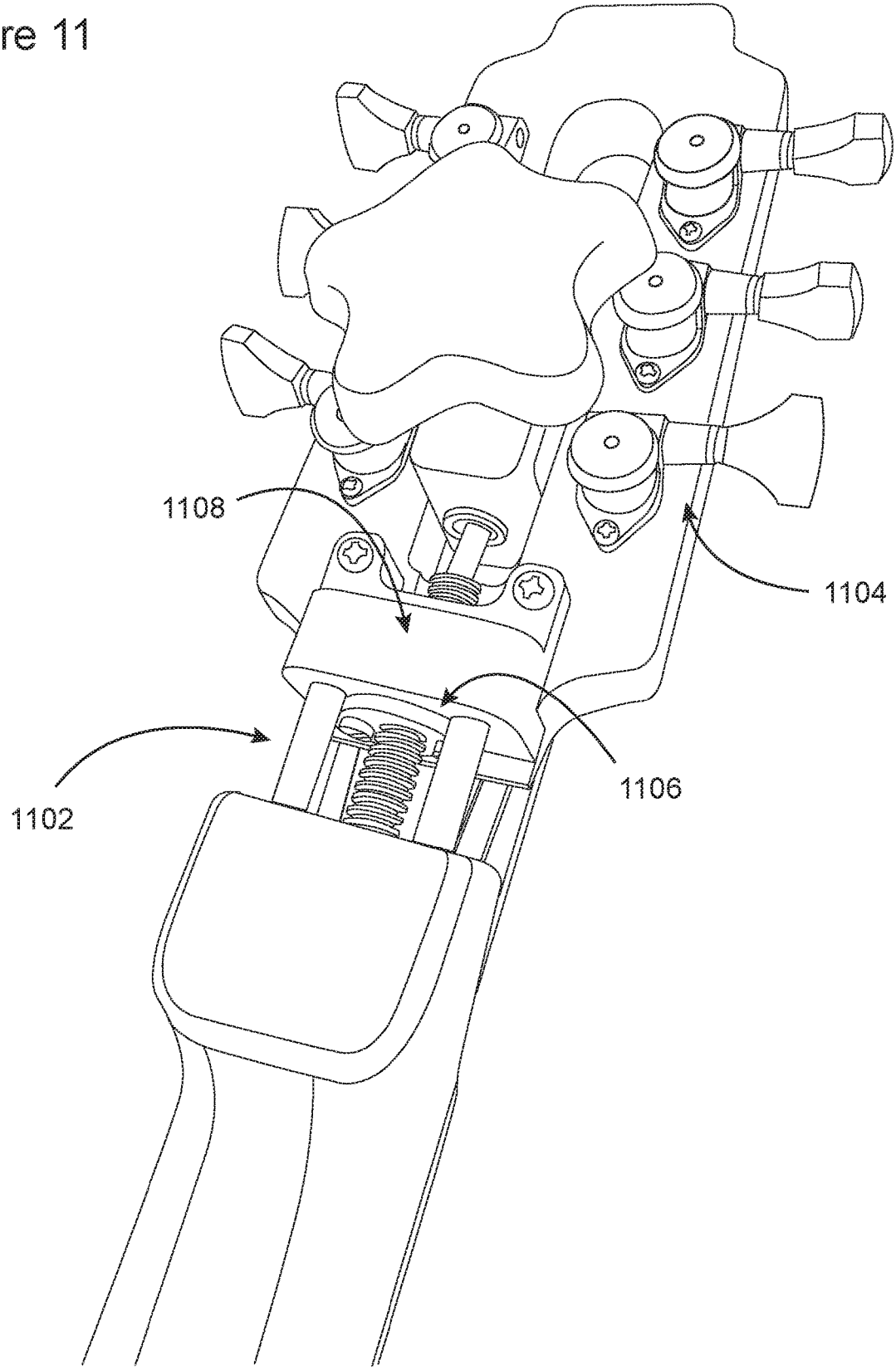
FIG. 11 shows how the top of the neck, the end surface which may be fitted with a metal bearing surface to prevent wear and deformation from the tensioning mechanism.

Making reference to FIG. 11, the top of the neck is fitted with a metal bearing surface to prevent wear and deformation from the tensioning mechanism. The neck features a removable headstock, which anchors the strings opposite the bridge. It may mount mechanically to the neck by way of pins 1102, latches, hooks, etc. This system of mounting enables lateral movement of the headstock but prevents rotational movement. This headstock may feature functional mechanical elements such as string locks, string guides, tuners 1104, or touch points. Tuners 1104 may be omitted at the headstock in favor of a bridge-mounted tuning system.

The headstock features a tensioning mechanism FIG. 12 that allows slack to be introduced into the strings sufficient for the bridge to be removed from its mounting. This mechanism is mounted to the back of the headstock such that it does not interfere with the strings 1204. The tensioning mechanism operates by way of a lead screw 1202. The headstock moves laterally along the lead screw to add tension to or remove tension from multiple strings simultaneously. The lead screw rests against the top of the neck and may be supported by a bearing surface (not shown) on the neck to prevent deformation of the neck's surface.

The lead screw is rotated by way of a fitted knob 1206, lever, or key. This tool may be removable or fixed. Rotation may be transformed 90 degrees for ergonomic and aesthetic purposes by way of bevel 1302 or worm gears. If a gearbox 1304 is used, it is mounted in such a way that the headstock prevents its rotation. This may be achieved by way of additional bearing surfaces, with a slot in the headstock 1306, etc. The gearbox is not physically connected to the headstock FIG. 13, allowing the headstock to move along the lead screw 1202. The lead screw nut 1106 is mounted to a block 1108 that is fastened to the headstock. This block also features threaded holes into which the headstock pins 1102 are mounted. The pins are mounted behind the lead screw 1202 so that it bears most of the force of the strings while under tension. In the present iteration, a removable knob 1206 is mounted to a gearbox 1304 containing bevel gears 1302. The gearbox 1304 fits into a slot in the center of the headstock 1306 to prevent its rotation. The lead screw 1202 is press fit into the center of the minor bevel gear.

The invention claimed is:

1. A portable, modular platform used to assemble a stringed instrument, comprising:

a receiver unit constructed from two opposing, spaced-apart rigid rails, and wherein the receiver unit defines a top surface, a back surface, proximal and distal ends, and opposing outer side surfaces;

a neck block disposed at the distal end of the receiver unit;

a neck module having a top surface, a back surface and proximal and distal ends, and wherein the proximal end of the neck module is configured to be removably received by the neck block;

a bridge block having a top surface and a back surface, and wherein the bridge block is configured to be removably received between the opposing rails of the receiver unit;

a bridge mountable on the top surface of the bridge block;

a pick-up module having a top surface and a back surface, and wherein the pick-up module is configured to be removably received between the opposing rails of the receiver unit and between the bridge and neck blocks; and wherein the top surface of the pick-up module includes one or more pick-ups for detecting string vibrations and converting the string vibrations into electrical signals.

2. The platform of claim 1, wherein the neck, bridge and pick-up modules that removably attach to the receiver unit form a 6-string, a 12-string or a bass guitar.

3. The platform of claim 1, wherein one or both of the opposing side surfaces of the receiver unit are configured to receive instrument body pieces.

4. The platform of claim 3, wherein at least one of the instrument body pieces includes a cavity to receive an electrical control module.

5. The platform of claim 4, wherein the electrical control module receives and modifies the electrical signals from the pick-up module through wired or wireless interconnections between the pick-up module and the instrument body piece including the control module.

6. The platform of claim 4, wherein the electrical control module includes a top surface that is substantially flush with the top surface of the instrument body piece including the control module.

7. The platform of claim 1, further including a headstock that removably couples to the distal end of the neck module.

8. The platform of claim 7, wherein the headstock couples to the distal end of the neck module through an adjustable tensioning mechanism that allows slack to be introduced into strings between the headstock and bridge sufficient for the bridge to be removed from the bridge block.

9. The platform of claim 8, wherein the tightening mechanism facilitates lateral movement of the headstock while preventing rotational movement.

10. The platform of claim 8, wherein:

the headstock includes two parallel pins that slide into the distal end of the neck module; and the tensioning mechanism includes a lead screw that bears against the distal end of the neck module to adjust the distance between the headstock and the neck module.

11. The platform of claim 10, wherein the tensioning mechanism further includes a knob, lever, or key to turn the lead screw.

12. The platform of claim 1, further including one or more of the following control modules that removably couple to the platform:

amplifiers, sound effects, preamps, recording interfaces, signal buffers, and control surfaces.

13. The platform of claim 1, wherein the rails of the receiver unit are parallel.

14. The platform of claim 1, further including a support member that connects the rails of the receiver unit; and wherein the bridge block is on one side of the support member and the pick-up module is on the other side of the support member.

15. The platform of claim 1, further including a support member enabling two receiver units to be coupled to one another to construct an instrument with two necks.

* * * * *